US007507018B2

(12) United States Patent
Hozumi et al.

(10) Patent No.: US 7,507,018 B2
(45) Date of Patent: Mar. 24, 2009

(54) WRISTWATCH AND BAND FOR WRISTWATCH

(75) Inventors: Yoshio Hozumi, Chiba (JP); Nobukazu Omori, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/005,001

(22) Filed: Dec. 20, 2007

(65) Prior Publication Data

US 2008/0159085 A1 Jul. 3, 2008

(30) Foreign Application Priority Data

Dec. 28, 2006 (JP) ..... 2006-354243

(51) Int. Cl.
*G04B 37/00* (2006.01)
*A44C 5/14* (2006.01)
*A45C 11/10* (2006.01)

(52) U.S. Cl. ..... 368/282; 224/177; 224/180

(58) Field of Classification Search ..... 368/281, 368/282; 224/164, 168, 177, 180
See application file for complete search history.

(56) References Cited

U.S. PATENT DOCUMENTS 4,234,115 A * 11/1980 Williams ..... 224/168
5,483,505 A * 1/1996 Cartier ..... 368/282
6,238,083 B1 * 5/2001 Hirano et al. ..... 368/282
7,210,844 B2 * 5/2007 Hiranuma et al. ..... 368/282
7,380,979 B2 * 6/2008 Hiranuma et al. ..... 368/282

FOREIGN PATENT DOCUMENTS

JP 61154604 9/1986
JP 62079419 5/1987

* cited by examiner

*Primary Examiner*—Vit W Miska
(74) *Attorney, Agent, or Firm*—Adams & Wilks

(57) ABSTRACT

To provide a wristwatch in which an attachment/detachment operation of an end piece of a band in regard to bow feet of a case band is easy. A concave part is formed in a back face of an end piece of a band and, under a state in which the piece is received in a bow crotch between adjoining bow feet, through-holes facing on attachment holes of the bow feet are respectively provided in side walls of the piece. The rotation member is rotatably held in the concave part. From one end to the other end, one pair of cam holes of shapes in which distances in regard to a center of a rotation member become gradually small are point-symmetrically provided in the rotation member, and a rotation operation groove is provided between these cam holes. Connection end parts of one pair of connection members forming L-shapes are passed through the through-holes, and cam follower end parts of the connection members are inserted into the cam holes. There is made such that, when the rotation member is rotated and the cam follower end parts are disposed in the one ends of the cam holes, the connection end parts are inserted into the attachment holes and, when the rotation member is rotated and the cam follower end parts are disposed in the other ends of the cam holes, the connection end parts are pull-drawn from the attachment holes.

18 Claims, 8 Drawing Sheets

WRISTWATCH AND BAND FOR WRISTWATCH

BACKGROUND OF THE INVENTION

1. Field of the Invention

The present invention relates to a wristwatch used while being worn to a human body's arm by using a band, and the band for the wristwatch detachably attached to a case band of this wristwatch.

2. Description of the Related Art

Hitherto, in an attachment of the band to the case band of the wristwatch, it is general to use a so-called spring bar. The spring bar is formed with two stepped pins and a coil spring being accommodated in a tube whose both ends parts are reduced. A small diameter axle part that the stepped pin has is protruded from an end of the tube, and inserted into an attachment hole bored in a protrusion part (bow foot) of the case band. By it, the band is connected to the case band. The coil spring is nipped between the two stepped pins, and biases these stepped pins in mutually reverse directions. Accordingly, by push-operating this stepped pin to the tube to thereby be removed from the attachment hole, it is possible to detach the band from the case band (e.g., refer to JP-A-61-154604 Gazette (Paragraph of Detailed Description of the Invention, FIG. 1-FIG. 4)).

Additionally, there is known a technique in which an attachment/detachment of the and in regard to the case band is made possible by moving a stepped connection axle, in which small diameter parts are protrusively provided in both ends of a large diameter part whose diameter matches with the attachment hole of the protrusion part (bow foot) of the case band, in a direction along which adjoining protrusion parts queue while forming a bow crotch receiving an end part of the band, thereby causing it to penetrate through the attachment hole of one protrusion part (bow foot) (e.g., refer to JP-A-61-154604 Gazette (Paragraph of Detailed Description of the Invention, FIG. 1-FIG. 4)).

Further, there is also known a technique in which, in order that the spring bar can be operated by bare hands when attaching/detaching the band to/from the case band, there is provided, in one expansion/contraction axle part protruded from one end of a spring bar main body, a protrusion making it possible to operate this axle part by the bare hands. There is also known the fact that, in this case, a notch is provided in an end part of an end piece of a metal-made band, and the above protrusion for the operation can be accommodated in this notch (e.g., refer to Microfilm of Utility Model Application No. Sho 60-1070446 (JP-UM-A-62-79419) (Paragraph of Detailed Description of the Device, FIG. 1-FIG. 3)).

In the technique of JP-A-61-154604 Gazette, in which there is used the spring bar or the technique in which there is used the stepped connection axle, since an exclusive tool is required in order to remove the spring bar or the stepped connection axle from the protrusion part (bow foot) of the case band, an operation when detaching the band is troublesome. Therefore, as to a band exchange, a difficulty is high for a user having near no tool.

Additionally, in the technique of JP-A-61-154604 Gazette, in which there is used the stepped connection axle, in addition to the fact that a thickness of the small diameter part of this axle is made a thickness exhibiting a predetermined strength such that this small diameter part is not bent easily, the attachment hole of the protrusion part (bow foot) must be formed large such that the large diameter part, whose thickness is additionally thicker than the last-mentioned thickness, can be inserted/retracted. Therefore, it is not only disadvantageous in thinning the case band, but also a reduction in commodity property is brought about because the band easily, loosely moves especially in a 12 o'clock-6 o'clock direction resulting from the fact that a large clearance is formed between the large diameter attachment hole and the small diameter part of the stepped connection axle. Additionally, since the stepped connection axle is not held to the band, a fear that an existence of the stepped connection axle becomes unclear during custody of the band is high.

In the technique of Microfilm of Utility Model Application No. Sho 60-1070446 (JP-UM-A-62-79419), although there is provided a manually operating protrusion for release-operating the spring bar, unless this protrusion is made thinner than a thickness of an attachment leg (bow foot) of the case band, a possibility that the protrusion beats against a wrist of the user in an ordinary use becomes high. Therefore, it is unavoidable that the protrusion becomes inevitably small. Moreover, the above protrusion is disposed so as to be nipped between an end part side face of the band and a side face of the attachment leg of the case band. Accordingly, manually operating the above protrusion accompanies actually a considerable difficulty, and rather using the exclusive tool is much easier to operate.

SUMMARY OF THE INVENTION

It is an aspect of the present invention to provide the wristwatch and the band for the wristwatch, in each of which an attachment/detachment operation of the end piece of the band in regard to the bow feet of the case band is easy.

A wristwatch of the present invention is made such that in a wristwatch in which a band is detachably attached to a case band in which bow feet having attachment holes are protrusively provided and a bow crotch is formed between the adjoining bow feet, a concave part is formed in a back face of an end piece, of the band, received so as to be capable of being put in and out to and from the bow crotch, and through-holes facing on the attachment holes and communicating with the concave part under a state in which the end piece is received in the bow crotch are provided respectively in side walls, of the end piece, placed in both sides of the concave part; a rotation member having one pair of cam holes provided point-symmetrically and a rotation operation groove provided between these cam holes is rotatably held in the concave part with at least the rotation operation groove being exposed, and the cam hole is made a shape in which a distance in regard to a center of the rotation member becomes gradually small as going from one end to the other end of this cam hole; connection end parts comprising one end parts of one pair of connection members formed in L-shapes are passed through the through-holes, and cam follower end parts comprising the other end parts of the connection members are inserted into the cam holes; and the connection end parts are inserted into the attachment holes when the cam follower end parts are disposed in one ends of the cam holes by rotating the rotation member, and the connection end parts are pulled out from the attachment holes when the cam follower end parts are disposed in the other ends of the cam holes by rotating the rotation member.

In the present invention and each invention mentioned below, besides the end piece of the band, a band portion may be one formed by rotatably connecting plural band pieces made of a metal, or one formed by a belt of a non-metal such as natural leather or artificial leather or synthetic resin. In the present invention and each invention mentioned below, it is desirable that a shape of the concave part is a quadrangular shape or a circular shape. Further, although it is desirable that the cam hole of the rotation member is made like an arc, it can be formed like a straight line as well. In the present invention and each invention mentioned below, in order to make such that, when the connection end part of the connection member is inserted into the through-hole of the bow foot, it is not caught, there suffices if a chamfer is applied to at least one between an inlet of the through-hole, of the bow foot, into/from which the connection end part of the connection member is inserted/retracted, in other words, an end part of the through-hole facing on the bow crotch, and a tip of the connection end part. In the present invention, although the rotation operation groove of the rotation member may be one in which a tip part of the exclusive tool can be inserted into and retracted from the rotation operation groove, it is desirable that it is a constitution in which a tip part of a screw driver existing near or a periphery part of a coin can be inserted and retracted.

In the wristwatch of the present invention, after there is made a state in which the connection end parts of the connection members do not protrude from both side edges of the end piece possessed in the band, following upon the fact that positions in which the cam follower end parts of the connection members engage with the cam holes of the rotation member change relatively by putting the end piece into the bow crotch between the adjoining bow feet of the case band and rotating the rotation member, it is possible to protrude the connection end parts of the one pair of connection members from the both side edges of the end piece by moving the connection end parts of these connection members in a direction mutually separating. By it, the connection end parts of the connection members are inserted into the attachment holes of the bow feet facing on the through-holes of the end piece at a point-blank range, so that the band is attached to the case band.

Reversely to this, under a state in which the band is attached to the case band, by rotating the rotation member in a direction reverse to the case of the above attachment, the engagement positions between the cam holes and the cam follower end parts change relatively, so that it is possible to move the one pair of connection members in a direction mutually approaching. By this, since the connection end parts are pulled out from the attachment holes of the bow feet and sink into the through-holes of the end piece, it is possible to detach the band from the case band.

When attaching/detaching the band to/from the case band like this, in order to rotation-operate the rotation member, there can be implemented, e.g., by inserting the periphery part of the coin exiting near into the rotation operation groove of the rotation member. In this case, since a work in a very narrow space between the bow foot and the end piece is not required and there can be operated in an opened back face side of the end piece, it is possible to improve an attachment/detachment operability of the end piece in regard to the case band.

A band for a wristwatch of the present invention is made such that in a band for a wristwatch, which is possessed in the wristwatch in which bow feet having attachment holes are provided in a case band, and possesses an end piece received so as to be capable of being put in and out to and from a bow crotch formed between the bow feet and detachably attached to the case band, a concave part is formed in a back face of an end piece of the band, and through-holes facing on the attachment holes and communicating with the concave part under a state in which the end piece is received in the bow crotch are provided respectively in side walls, of the end piece, placed in both sides of the concave part; a rotation member having one pair of cam holes provided point-symmetrically and a rotation operation groove provided between these cam holes is rotatably held in the concave part with at least the rotation operation groove being exposed, and the cam hole is made a shape in which a distance in regard to a center of the rotation member becomes gradually small as going from one end to the other end of this cam hole; connection end parts comprising one end parts of one pair of connection members formed while being bent in L-shapes are passed through the through-holes, and cam follower end parts comprising the other end parts of the connection members are inserted into the cam holes; and the connection end parts are inserted into the attachment holes when the cam follower end parts are disposed in one ends of the cam holes by rotating the rotation member, and the connection end parts are pulled out from the attachment holes when the cam follower end parts are disposed in the other ends of the cam holes by rotating the rotation member.

The band for the wristwatch of the present invention can be easily attached/detached to/from the case band of the wristwatch by the same operation as one already explained in the invention of the wristwatch.

In desirable modes of the wristwatch and the band for the wristwatch of the present invention, the rotation operation groove forms a shape having a width and a length, which can receive a periphery part of a coin, and this rotation operation groove is provided between one ends of the one pair of cam holes so as to become parallel to the connection end parts.

In modes of these inventions, it is possible to easily attach/detach the end piece of the band to/from the bow feet of the case band by using the coin existing near without requiring the exclusive tool. Moreover, since directions along which the rotation operation groove and the connection end part extend are the same, for a worker it is easy to recognize a mutual position relations between the connection end part of the connection member and the rotation operation groove and, therefore, it is desirable for suppressing the rotation member in its direction error of an rotation operation.

In desirable modes of the wristwatch and the band for the wristwatch of the present invention, a stabilization plate contacting with a back face of the rotation member is attached by being pressed in to an outer periphery of the cam follower end part. For the stabilization plate, it is possible to use a ring made of a synthetic resin, or the like.

In modes of these inventions, the fact that, following upon the rotation operation of the rotation member, the cam follower end part moves in a direction coming down in the cam hole is prevented by a contact between the stabilization plate moved monolithically with the connection member and the back face of the rotation member, and thereby it is possible to suppress the fact that the cam follower end part vies with the cam hole during the rotation operation of the rotation member.

In desirable modes of the wristwatch and the band for the wristwatch of the present invention, there is made such that a moderation protrusion is provided in any one between the rotation member and a presser plate attached to the back face of the end piece while covering a periphery part of the rotation member so as to hold the rotation member in the concave part and in the other there is provided a moderation groove with/from which the moderation protrusion is engaged/disengaged while following upon a rotation of the rotation member, and, under a state in which the connection end parts are inserted into the attachment holes, the rotation member is positioned by engaging the moderation protrusion and the moderation groove.

In modes of these inventions, by obtaining a moderation feeling following upon an engagement between the moderation protrusion and the moderation groove, it is possible to perceive the fact that the band is attached to the case band with the connection end part of the connection member being inserted into the attachment hole of the bow foot, and it is possible to hold a state in which the band is attached to the case band with a free rotation of the rotation member being suppressed by the above engagement.

In desirable modes of the wristwatch and the band for the wristwatch of the present invention, there is possessed a bias means biasing the rotation member toward the presser plate. In a mode of this invention, for the bias means, although it is possible to typically use a bias member, e.g., a coil spring, instead of this, by providing in the rotation member itself a site bending under a state in which the rotation member is attached to the end piece, it is also possible to bias by a force that this site attempts to solve the bend.

In modes of these inventions, since the rotation member is press-held to the presser plate, the fact that the rotation member backlashes can be suppressed, and it is possible to cause the moderation feeling following upon the engagement between the moderation protrusion and the moderation groove to clearly appear.

According to the present invention, there can be provided the wristwatch and the band for the wristwatch, in each of which the attachment/detachment operation of the end piece of the band in regard to the bow feet of the case band is easy.

DESCRIPTION OF THE PREFERRED EMBODIMENTS

A first embodiment of the present invention is explained by referring to FIG. 1-FIG. 6.

Figure 1:
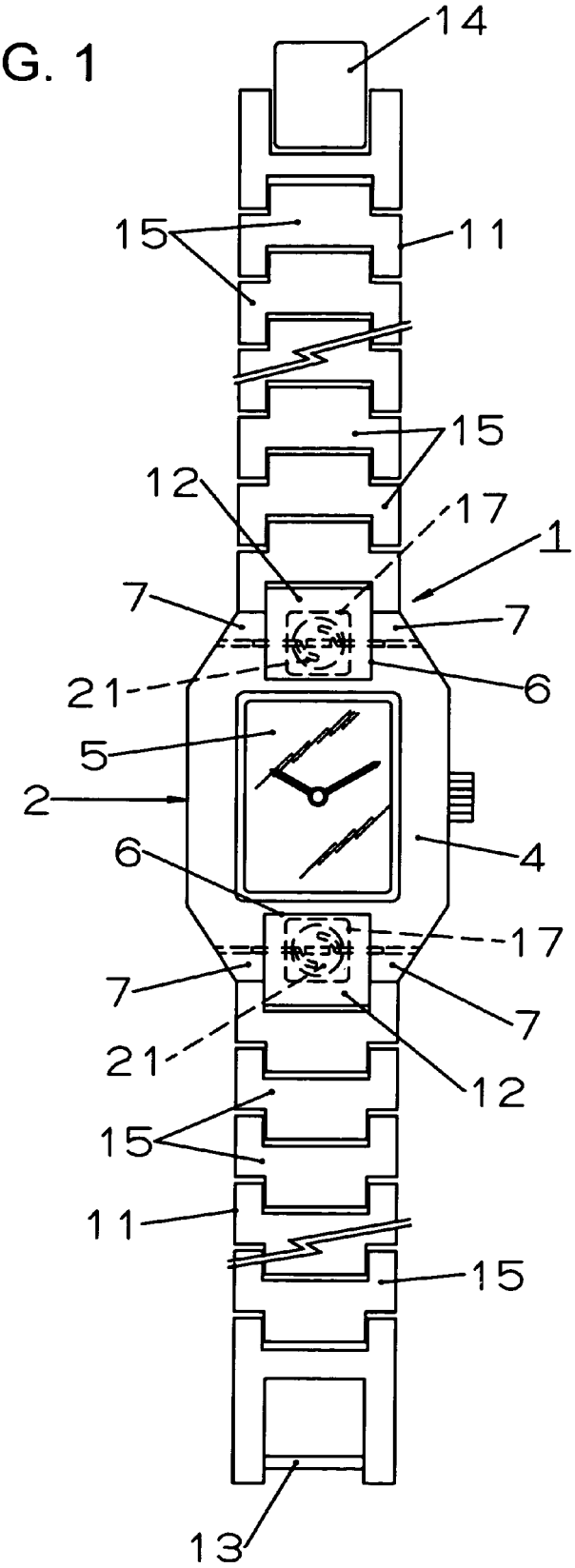
FIG. 1 is a front view showing a wristwatch concerned with a first embodiment of the present invention.

In FIG. 1, a reference numeral 1 denotes a wristwatch. In a timepiece armor assembly 2 that this wristwatch possesses, there are accommodated a dial, a timepiece movement and the like, which are not shown in the drawing. The timepiece armor assembly 2 possesses a case band 4 made of a metal or a hard synthetic resin. The case band 4 is like an approximately quadrangular annulus for instance and, in its front face, there is mounted a cover glass 5 and, in its back face, there is mounted a case back (not shown in the drawing). The dial is visible through the cover glass 5.

In an outer periphery of the case band 4, bow crotches 6 are respectively provided while corresponding to a 12 o'clock-6 o'clock direction of the dial. Each of these bow crotches 6 is used as a concave part receiving an end piece mentioned later, provided monolithically, protrusively from the outer periphery of the case band 4, and formed between one pair of bow feet 7 adjoining in a left-right direction (9 o'clock-3 o'clock direction). The bow feet 7 are used as band attachment convex parts and, as shown in FIG. 2-FIG. 5, an attachment hole 8 opening to the bow crotch 6 is respectively provided in each of the respective bow feet 7. The attachment hole 8 may be provided while penetrating through the bow foot 7 so as to extend along the 9 o'clock-3 o'clock direction of the dial, or may not penetrate though the same.

Figure 2:
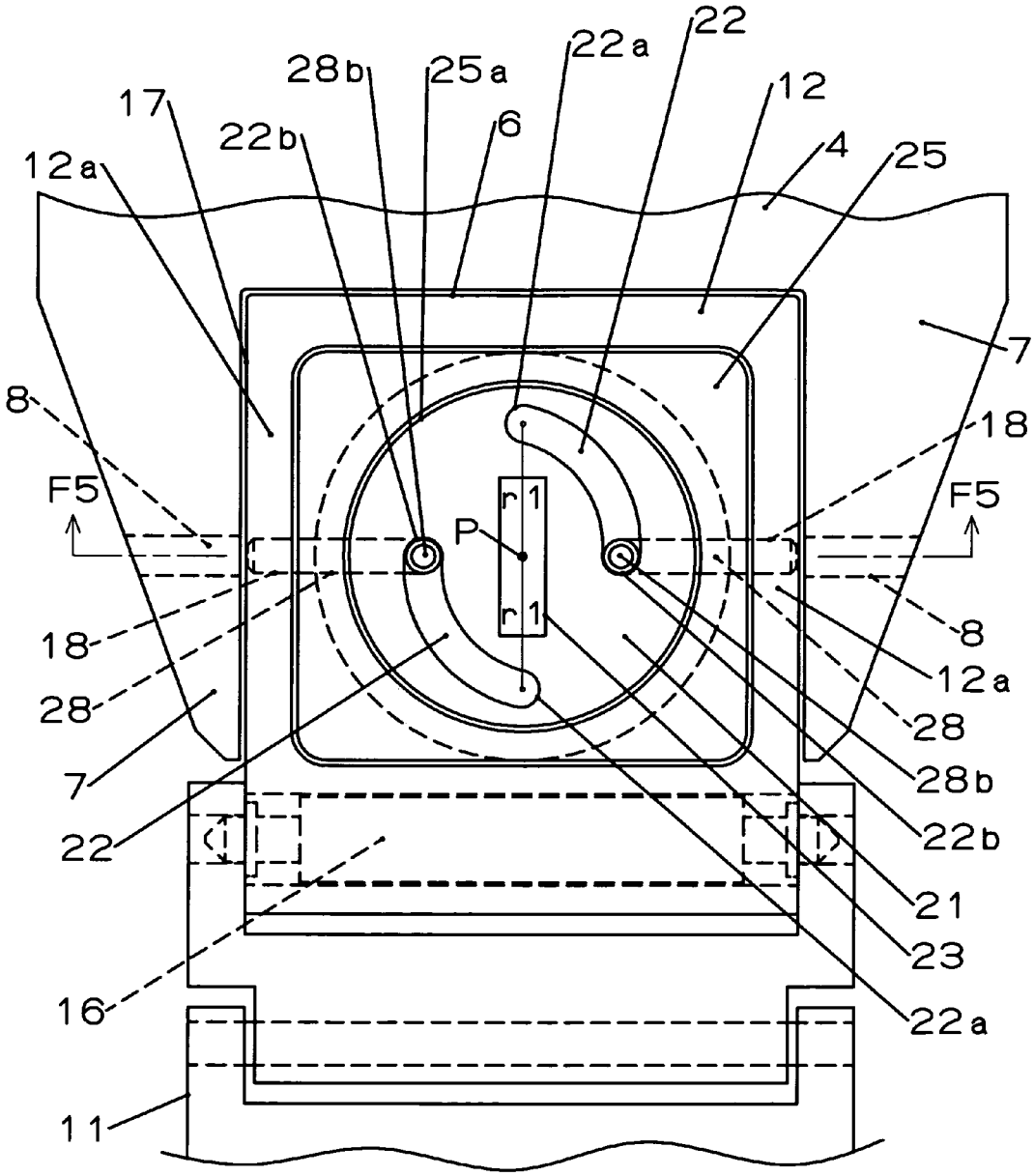
FIG. 2 is a back view showing a band connection part of the wristwatch of FIG. 1 under a state in which a connection of a band in regard to a case band is released.
Figure 3:
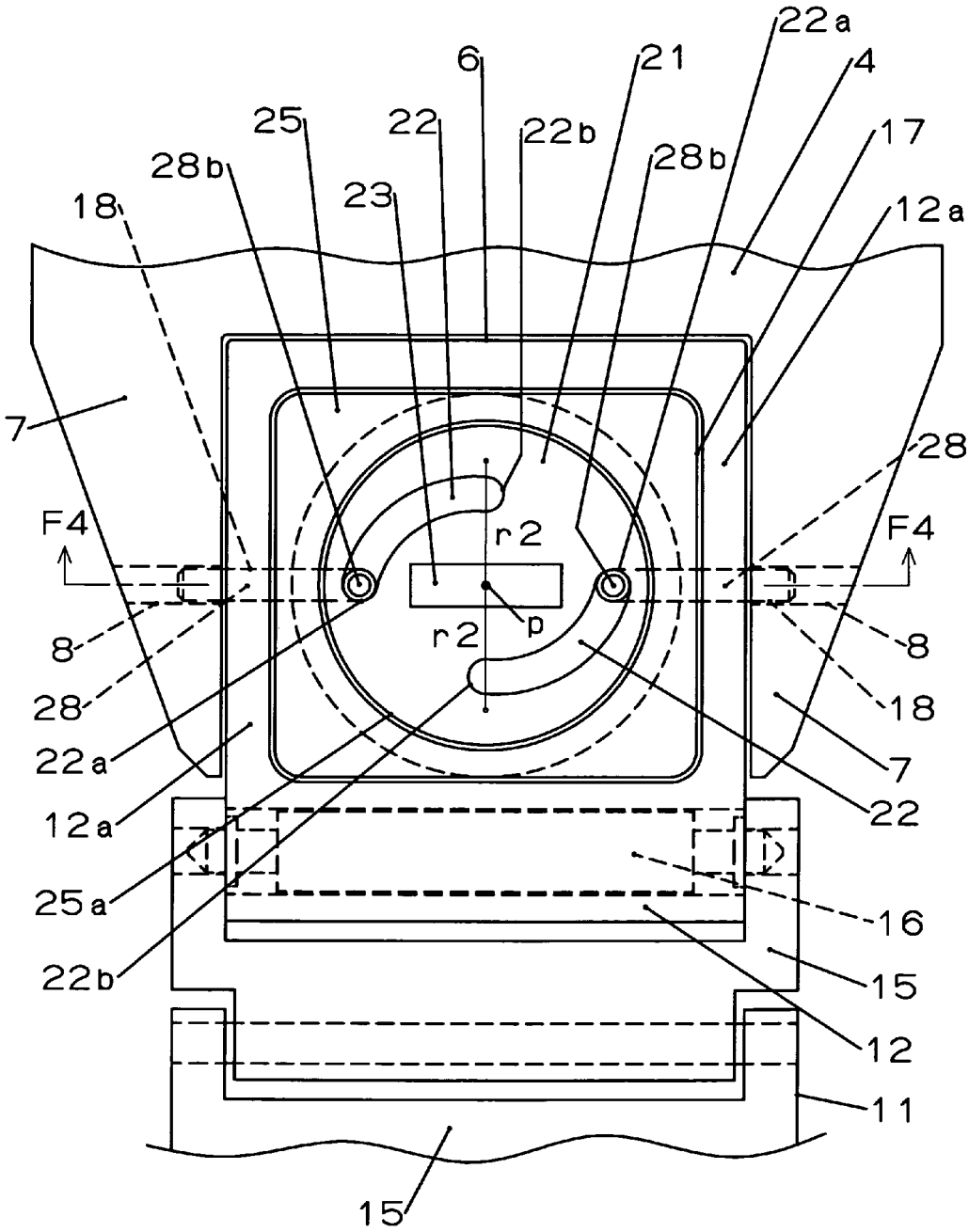
FIG. 3 is a back view showing the band connection part of the wristwatch of FIG. 1 under a state in which the band is connected to the case band.

A reference numeral 11 in FIG. 1-FIG. 3 denotes a band for wearing the wristwatch to the human body arm. The band 11 of the present embodiment is formed by connecting a metal-made end piece 12 to one end of a row of band pieces 15, and connecting a connection member 13 or 14 to the other end. The band piece row is formed by plural metal-made band pieces 15 mutually, rotatably connected. Incidentally, a reference numeral 16 in FIG. 2 and FIG. 3 denotes a spring bar connecting the end piece 12 and the band 11 adjoining the former, and further the connection members 13, 14 are capable of mutually engaging/disengaging.

Figure 4:
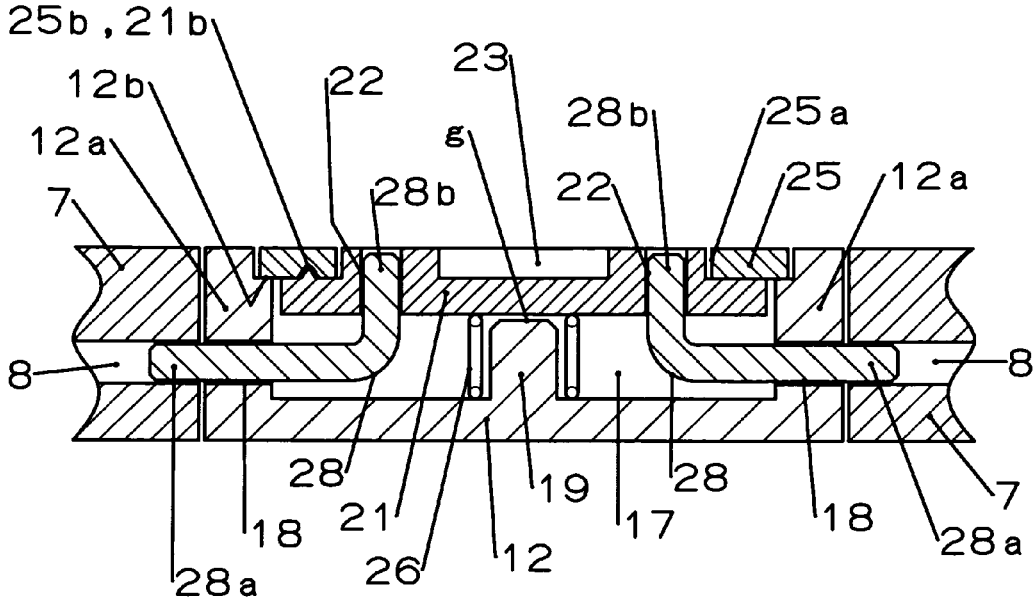
FIG. 4 is a sectional view along an F4-F4 line in FIG. 3.
Figure 5:
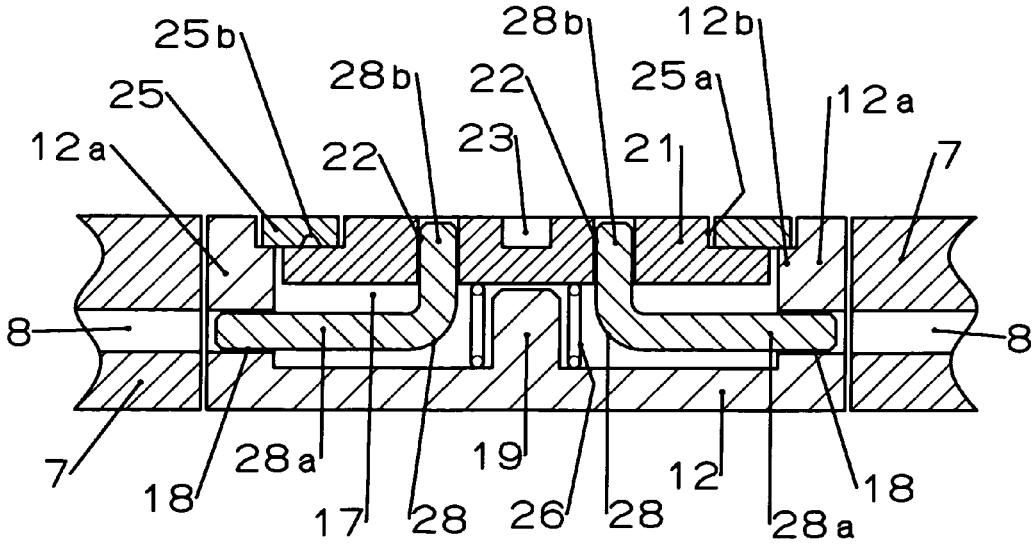
FIG. 5 is a sectional view along an F5-F5 line in FIG. 2.

As shown in FIG. 4 and FIG. 5, in each end piece 12, there is formed a concave part 17 opening to a back face of the former. The concave part 17 is a quadrangular shape for instance. In side walls placed in both left-right sides of the concave part 17, in other words, side wall 12*a* placed so as to nip the end piece 12 in its width direction, through-holes 18 penetrating through these walls are respectively bored. Therefore, one end of the through-hole 18 is opened to an inner face of the side wall 12*a* facing on the concave part 17, and the other end is opened to an outer face of the side wall 12*a*. A diameter of the through-hole 18 is approximately equal to a diameter of the attachment hole 8.

In an inner periphery face of an open end part of the concave part 17, there is formed a step part. 12*b* continuing in a peripheral direction. In a center part of a bottom face (interior face) of the concave part 17, a convex part 19 is monolithically, protrusively provided. A height of the convex part 19 is lower than a depth of the concave part 17.

A rotation member 21 is rotatably accommodated in the concave part 17, and a metal-made presser plate 25 forming a latch of this rotation member 21 from the concave part 17 is attached to a back face of the end piece 12. An outer periphery of the presser plate 25 forms an external shape corresponding to a shape of the concave part 17, e.g., quadrangle, and the presser plate 25 is fixed to the end piece 12 by mounting this outer periphery part to the above step part 12*b* and welding several places of the outer periphery part to the end piece 12. A front face of the fixed presser plate 25 becomes approximately flat-topped with the back face of the end piece 12. The presser plate 25 has a circular hole 25*a*.

Figure 6A:
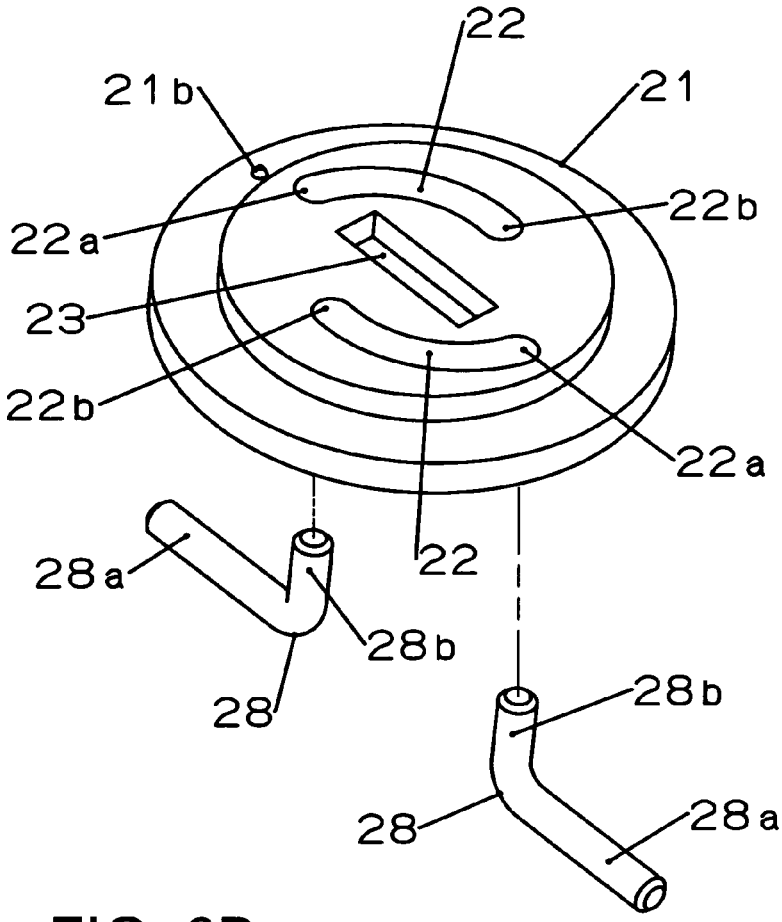
FIG. 6A is a perspective view showing a rotation member and one pair of connection members, that the wristwatch of FIG. 1 possesses, under a state in which they are disassembled.
Figure 6B:
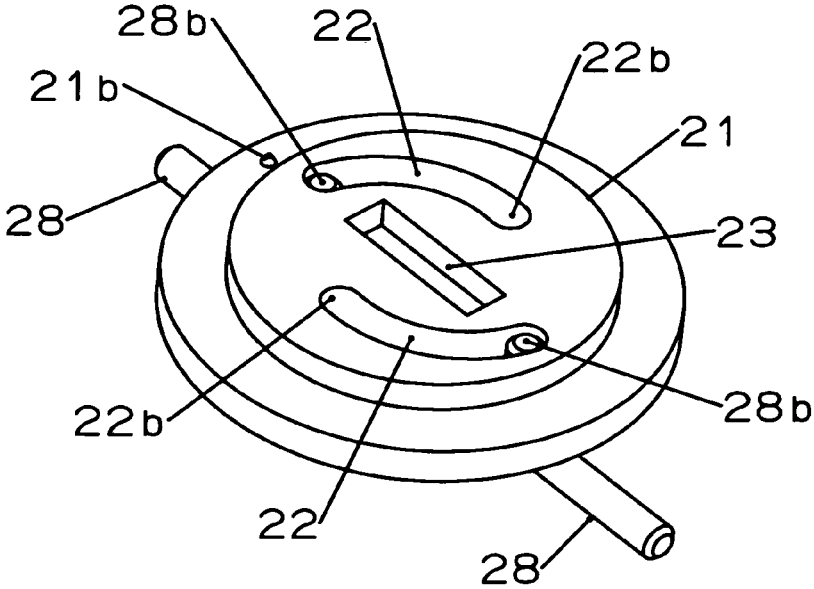
FIG. 6B is a perspective view showing the rotation member and the one pair of connection members under a state in which they are combined.

As shown in FIG. 6 and the like, the rotation member 21 forms a disc shape in which a center part is thicker than a periphery part, and the periphery part is thinly formed while having a step in regard to the center part. A protrusion height of the center part of the rotation member 21 in regard to the periphery part, in other words, a height of the step, is approximately the same as a thickness of the presser plate 25. Additionally, the center part is circular as well, and its diameter is slightly smaller than the hole 25*a*.

The rotation member 21 is covered in its periphery part by the presser plate 25, and accommodated in the concave part 17 with the center part being fitted to the hole 25*a* of the presser plate 25. As shown in FIG. 4 and FIG. 5, by a bias means, e.g., a coil spring 26, provided in the concave part 17, the rotation member 21 is pressed to the presser plate 25. The coil spring 26 is disposed with the above convex part 19 being accommodated in an inside and, by it, held in a predetermined position pressing the center part of the rotation member 21. By a bias of the coil spring 26, under an ordinary state, a slight interstice g (refer to FIG. 4) is formed between the rotation member 25 and a tip of the convex part 19. By this interstice g, it is made possible that, when the rotation member 21 is pressed, the rotation member. 21 can displace in a bottom face direction of the concave part 17 so as to vanish the interstice g.

As shown in FIG. 2-FIG. 6, in the thick center part of the rotation member 21, there are provided one pair of cam holes 22 and one rotation operation groove 23.

The one pair of cam holes 22 penetrate through the rotation member 21, and are disposed point-symmetrically in regard to a center P of the rotation member 21. Moreover, the cam hole 22 is formed in a shape, e.g., an ark-like shape, in which a distance in regard to the center P becomes gradually small as going from its one end 22*a* to the other end 22*b*. Incidentally, in FIG. 2 and FIG. 3, a sign r1 denotes a length of a linear distance connecting the center P and the one end 22*a* along a radial direction of the rotation member 21, r2 denotes a length of a linear distance connecting the center P and the other end 22*b* along the radial direction of the rotation member 21, and they are r1>r2.

The rotation operation groove 23 is made in an elongate shape having a width and a length, which can receive the periphery part of the coin. Incidentally, it is also possible that the rotation operation groove 23 receives a tip part of a general screw driver besides the periphery part of the coin. The rotation operation groove 23 is provided, with its longitudinal direction both ends being corresponded to the one ends 22*a* of one pair of cam holes 22, between these. By it, the rotation operation groove 23 can be made parallel to a connection end part mentioned later under a state in which the band 11 is attached to the case band 3.

One pair of connection members 28 are attached over the rotation member 21 and the end piece 12. These connection members 28 are made of a metal for instance, and formed with a round bar of approximately the same diameter as the attachment hole 8 and the through-hole 18 being bent in an L-shape as shown in FIG. 4, FIG. 5, FIG. 6(A). One end part of the connection member 28 forms a connection end part 28*a*, and the other end part of the connection member 28 forms a cam follower end part 28*b*. The connection end part 28*a* is longer than the cam follower end part 28*b*.

The connection member 28 is provided with its connection end part 28*a* being inserted into the through-hole 18 of the end piece 12 and the cam follower end part 28*b* being inserted into the cam hole 22 of the rotation member 21. Therefore, the one pair of connection members 28 are disposed such that tips of these connection end parts 28*a* mutually recede in reverse directions. A length of the cam follower end part 28*b* is set to such a length that its tip sinks in the rotation member 21 without protruding from a front face of the rotation member 21.

By changing an engagement position between the cam follower end part 28*b* and the cam hole 22 by manually rotating the rotation member 21, the connection members 28 can be moved in mutually approaching-separating directions. And, by this movement, the connection end parts 28*a* are protruded or sunk in regard to outer faces of both the side faces 12*a* of the end piece 12. The protruded connection end parts 28*a* connect the band 11 to the case band 4 while being inserted into the attachment holes 8 of the bow feet 7. And, there is made such that this connection is released by the fact that the connection end parts 28*a* sink into the side walls 12*a*.

A tip of the connection end part 28*a* and a tip of the cam follower end part 28*b* are respectively chamfered. Incidentally, it is also possible to work like a semicircle instead of the chamfer. By such a contrivance in regard to the tip of the connection end part 28*a*, irrespective of a dispersion of a dimensional accuracy, it is possible to complete an insertion/retraction of the connection end part 28*a* to/from the attachment hole 8 by making such that the connection end part 28*a* is not caught by an inlet of the this attachment hole 8. By the above contrivance in regard to the tip of the cam follower end part 28*b*, even in a case where the tip of the cam follower end part 28*b* is slightly protruded from the front face of the rotation member 21 by the dispersion of the dimensional accuracy, it is possible to make so as not to give a foreign matter feeling to a human body's hand.

As shown in FIG. 4 and FIG. 5, a moderation groove 25*b* is provided in the presser plate 25. Corresponding to this, a moderation protrusion 21*b* is provided in a periphery part of the rotation member 21. Following upon a rotation of the rotation member 21, the moderation protrusion 21*b* is engaged with and disengaged from the moderation groove 25*b* and, by that engagement, the rotation member 21 is positioned in a predetermined position. That is, there is made such that, under a state in which the connection end part 28*a* is inserted into the attachment hole 8, the moderation protrusion 21*b* and the moderation groove 25*b* engage, thereby holding the rotation member 21 in a stationary state such that this engagement is not disengaged carelessly. Incidentally, instead of the above constitution, the moderation protrusion 21*b* may be provided in the presser plate 25, and the moderation groove 25*b* may be provided in the periphery part of the rotation member 21.

Procedures for attaching the band 11 to the case band 4 are explained.

First, in a case where there is a necessity, a tip part of the connection end part 28*a* of the connection member 28 is retracted into the through-hole 18. This operation is implemented by rotating the rotation member 21 after the periphery part of the coin (not shown in the drawing) as a member bearing a rotation operation of the rotation member 21 is put into the rotation operation groove 23 such that the rotation operation groove 23 of the rotation member 21 becomes a disposition extending in a longitudinal direction, in other words, a lengthwise direction of the band 11. Under this state, the one pair of connection members 28 exist in a most approached state, and tip parts of the connection end parts 28*a* of these connection members 28 are retracted into the through-holes 18 of the side walls 12*a* without protruding from these side walls 12*a* of the end piece 12.

Next, the end piece 12 of the band 11 is accommodated in the bow crotch 6 between the bow feet 7 protrusively provided in the case band 4, thereby opposing the through-hole 18 and the attachment hole 8 of the bow foot 7 at the point-blank range. A state in which the end piece 12 is received in the bow crotch 6 like this is shown in FIG. 2 and FIG. 5.

After this, the periphery part of the coin is put into the rotation operation groove 23, and the rotation member 21 is rotated such that the rotation operation groove 23 becomes a disposition in which the rotation operation groove 23 extends in a lateral direction, in other words, a width direction of the band 11. Each of the cam holes 22, into which there are inserted the cam follower end parts 28*b* of the one pair of connection members 28, is a shape in which a distance from the center P of the rotation member 21 becomes gradually large as going from its the other end 22*b* to one end 22*a*. By it, the rotation member 21 is rotated by about 90° with the coin and, following upon the fact that an engagement position of the cam follower end part 28*b* in regard to the cam hole 22 changes, the one pair of connection members 28 are press-moved in a direction mutually receding with the through-hole 18 being made a guide.

Therefore, the tip part of the connection end part 28*a* of each connection member 28 protrudes from the side wall 12*a* of the end piece 12, and is inserted respectively into the attachment hole 8 of the bow foot 7 facing on the through-hole 18. And, if there becomes such that the cam follower end part 28*b* engages with the one end 22*a* of the cam hole 22, at the same time as amore rotation of the rotation member 21 is hindered with the cam follower end part 28*b* being made a stopper, the moderation protrusion 21*b* of the rotation member 21 fits to the moderation groove 25*b* of the presser plate 25, and the rotation member 21 is positioned.

Accordingly, the band 11 is attached to the case band 4. A completion state of this attachment is shown in FIG. 3 and FIG. 5. Under the state in which the attachment is completed, since the rotation member 21 is pressed to the presser plate 25 by the coil spring 26, the fact that the rotation member 21 backlashes can be suppressed. Together with this, there can be made such that the connection end part 28*a* is not drawn out from the attachment hole 8 by the fact that an engagement between the moderation protrusion 21*b* and the moderation groove 25*b* is carelessly disengaged and the rotation member 21 is naturally rotated.

Procedures for detaching the band 11 from the case band 4 are explained.

First, under the state shown in FIG. 3, the periphery part of the coin is inserted into the rotation operation groove 23 of the rotation member 21, and the rotation operation groove 23 is rotated so as to become a disposition in the longitudinal direction extending in the lengthwise direction of the band 11. In this case, by the fact that initially the rotation member 21 is pressed down while resisting against the coil spring 26 so as to vanish the above interstice g, the rotation member 21 is rotated by about 90° after the engagement of the moderation protrusion 21*b* with the moderation groove 25*b* is easily disengaged.

As already mentioned, since each cam hole 22 into which there is inserted the cam follower end part 28*b* is the shape in which the distance from the center P of the rotation member 21 becomes gradually small as going from its one end 22*a* to the other end, following upon the fact that the engagement position of the cam follower end part 28*b* in regard to the cam hole 22 changes by the rotation of the rotation member 21, the one pair of connection members 28 are pull-moved in a direction mutually approaching with the through-hole 18 being made the guide. Therefore, the tip part of the connection end part 28*a* of each connection member 28 is drawn out from the attachment hole 8 of the bow foot 7 and sunk into the through-hole 18 so as not to protrude from the side wall 12*a* of the end piece 12. And, if there becomes such that the cam follower end part 28*b* engages with the other end 22*b* of the cam hole 22, the more rotation of the rotation member 21 is hindered with the cam follower end part 28*b* being made the stopper. This state is shown in FIG. 2 and FIG. 4.

Finally, by pulling out the end piece 12 of the band 11 from the bow crotch 6, it is possible to disengage the band 11 from the case-band 4.

Like the above, under the state in which the end piece 12 is disposed in the bow crotch 6 of the case band 4, by rotating the rotation member 21 holding the end piece 12, it is possible to attach/detach the band 11 to/from the case band 4 by putting in and out the connection end parts 28*a* of the one pair of connection members 28 to and from the attachment holes 8 of the bow feet 7.

When rotating the rotation member 21 in this attachment/detachment, even if the exclusive tool is not used especially, it is possible to utilize, e.g., the coin existing near. Moreover, it is unnecessary to perform an attachment/detachment operation in a narrow working space between the side faces of the end piece 12 and the bow feet 7, so that the attachment/detachment operation rotating the rotation member 21 in a wide working environment can be performed without being hindered by the bow feet 7. Accordingly, it is possible to easily attach/detach the band 11 to/from the case band 4.

Like this, since the attachment/detachment of the band 11 is easy, in a case where there is possessed the end piece 12 to which the rotation member 21 and the one pair of connection members 28 etc. are attached, and the user previously prepares at least one band 11 whose design differs, even for the user it becomes possible to use the wristwatch 1 while giving a change in the design to it by being easily, suitably exchanged to the band 11 desired, by the procedures already mentioned.

Additionally, since the rotation member 21 does not protrude from the end piece 12, and the operation part becoming a clue rotating this rotation member 21 is formed by the groove, in other words, the rotation operation groove 23, and does not protrude from the rotation member 21, there is no fact that it beats against the user's wrist under the state in which the wristwatch 1 is worn to the user's arm, so that a use feeling is good because it is difficult to give the foreign matter feeling. Moreover, since the cam follower end part 28*b* does not protrude from the cam hole 22, there is no fear that it contacts with the user's wrist under the state in which the wristwatch 1 is worn to the user's arm and, even if there is the fact that, resulting from the dispersion of component accuracy, the cam follower end part 28*b* contacts with the wrist, it is slight, so that the use feeling is good because it is difficult to give the foreign matter feeling.

Further, since a size of the attachment hole 8 of the bow foot 7 is approximately equal to a diameter of the connection end part 28*a* of the connection member 28, there is no fact that a large clearance is formed between the attachment hole 8 and the connection end part 28*a*. By it, the band 11 can be attached such that the band 11 does not easily play-move in the 12 o'clock-6 o'clock direction.

Figure 7:
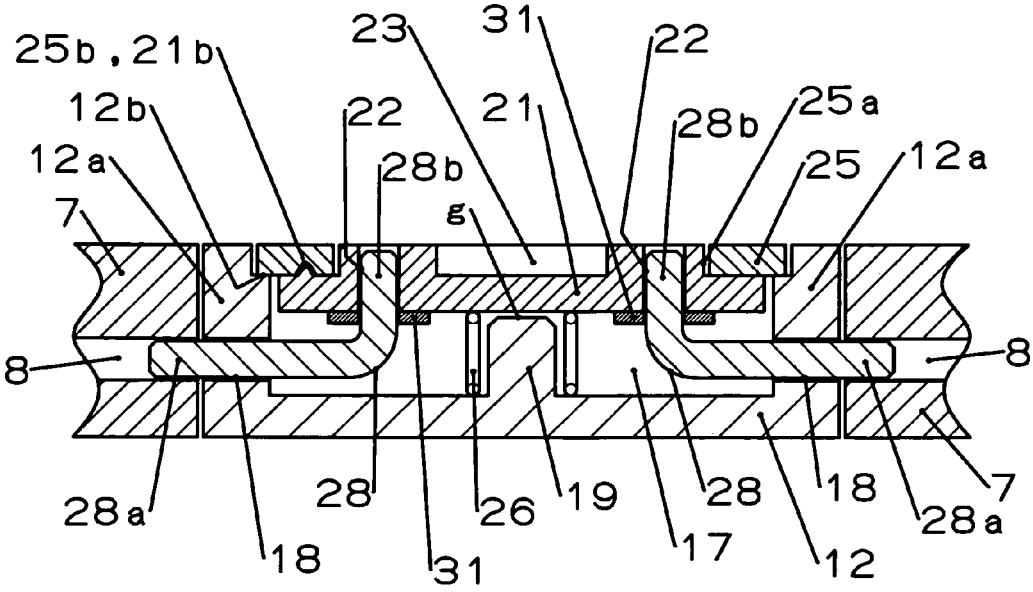
FIG. 7 is a sectional view showing a band connection part of a wristwatch concerned with a second embodiment of the present invention under the state in which the band is connected to the case band.
Figure 8:
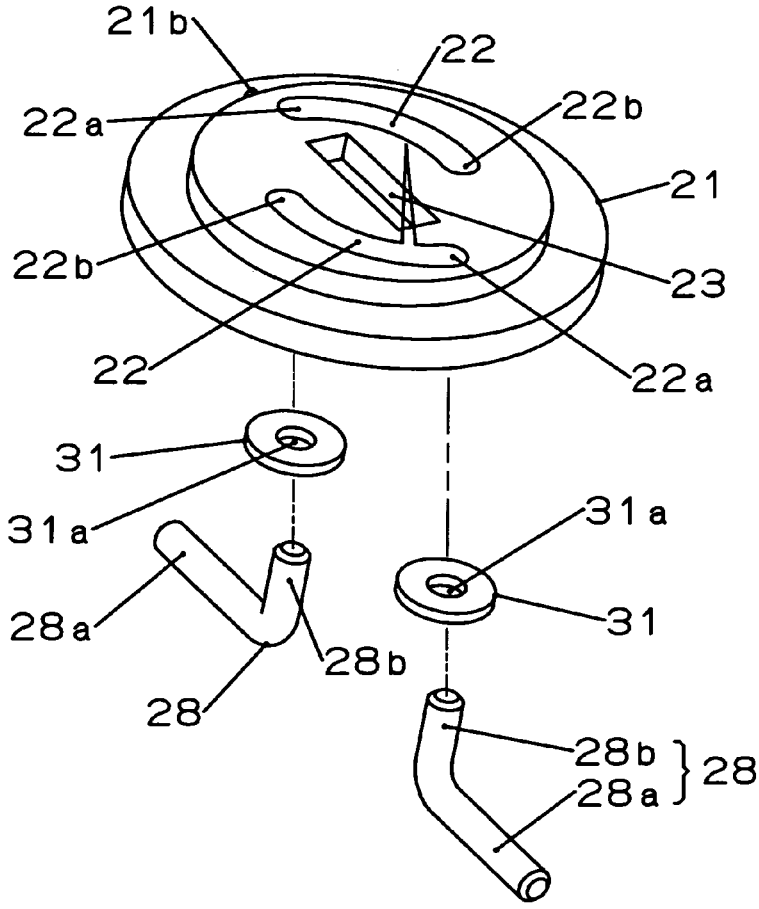
FIG. 8 is a perspective view showing the rotation member the one pair of connection members and a stabilization plate, that the wristwatch of FIG. 7 possesses, under a state in which they are disassembled.

FIG. 7 and FIG. 8 show a second embodiment of the present invention. Since the second embodiment is the same as the first embodiment except matters explained below, the same reference numeral as the first embodiment is applied about the same constitution as the first embodiment, and its explanation is omitted.

In the second embodiment, a stabilization plate 31 is attached respectively to the cam follower end part 28*b* of each connection member 28. The stabilization plate 31 comprises e.g., the hard synthetic resin or the metal, and forms a ring shape for instance. The stabilization plate 31 is attached with its center hole 31*a* (refer to FIG. 8) being pressure-inserted to the cam follower end part 28*b*, and provided while slidably contacting with the back face of the rotation member 21 as shown in FIG. 7. Matters other than the above are the same as the first embodiment.

Therefore, since the wristwatch of the second embodiment obtains the same actions as those explained in the first embodiment, for the user it is possible to easily attach/detach the end piece 12 of the band in regard to the bow feet 7 of the case band by using the coin or the like.

Moreover, since the stabilization plate 31 is possessed, there excels in the following point. That is, the fact that the cam follower end part 28*b* of the connection member 28 following upon the rotation operation of the rotation member 21 moves in a direction coming down in the cam hole 22 of the end piece 12 can be prevented by a contact between the stabilization plate 31 moved monolithically with the connection member 28 and the back face of the rotation member 21. Therefore, it is possible to smoothly rotate the rotation member 21 while following upon there is suppressed the fact that the cam follower end part 28*b* vies with the cam hole 22 during the rotation operation of the rotation member 21 when the band is attached/detached.

Figure 9:
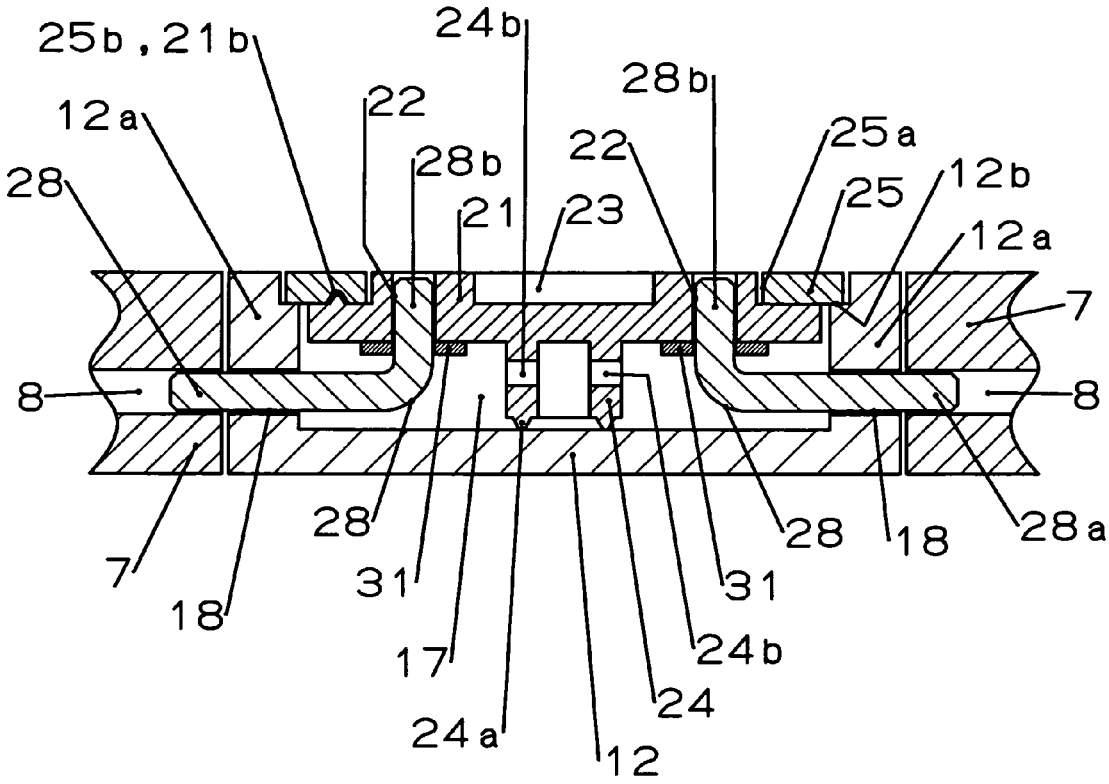
FIG. 9 is a sectional view showing a band connection part of a wristwatch concerned with a third embodiment of the present invention under the state in which the band is connected to the case band.

FIG. 9 shows a third embodiment of the present invention. Since the third embodiment is the same as the second embodiment except matters explained below, the same reference numeral as the second embodiment is applied about the same constitution as the second embodiment, and its explanation is omitted.

In the third embodiment, the rotation member 21 is made of the synthetic resin and, in its back face center part, there is monolithically formed a tubular convex part 24 protruding toward the bottom face of the concave part 17. An annular protrusion 24*a* that the tubular convex part 24 has in its tip is pressed to the bottom face of the concave part 17. In the tubular convex part 24, a cut groove 24*b* making possible an elastic deformation of this tubular convex part 24 in an axial direction is impartially provided along a peripheral direction of the tubular convex part 24. Matters other than the above are the same as the second embodiment.

Therefore, in the wristwatch 1 of the third embodiment, for the user it is possible to easily attach/detach the end piece 12 of the band in regard to the bow feet 7 of the case band by using the coin or the like.

Moreover, by the fact that the rotation member 21 is attached by pressing the annular protrusion 24*a* of the tubular convex part 24 to the bottom face of the concave part 17, the tubular convex part 24 is elastically deformed in the axial direction and, by a repulsion force following upon it, it is possible to press the rotation member 21 to the presser plate 25. Therefore, there excels in a point that in order to bias the rotation member 21, an especial component is not required.

Figure 10:
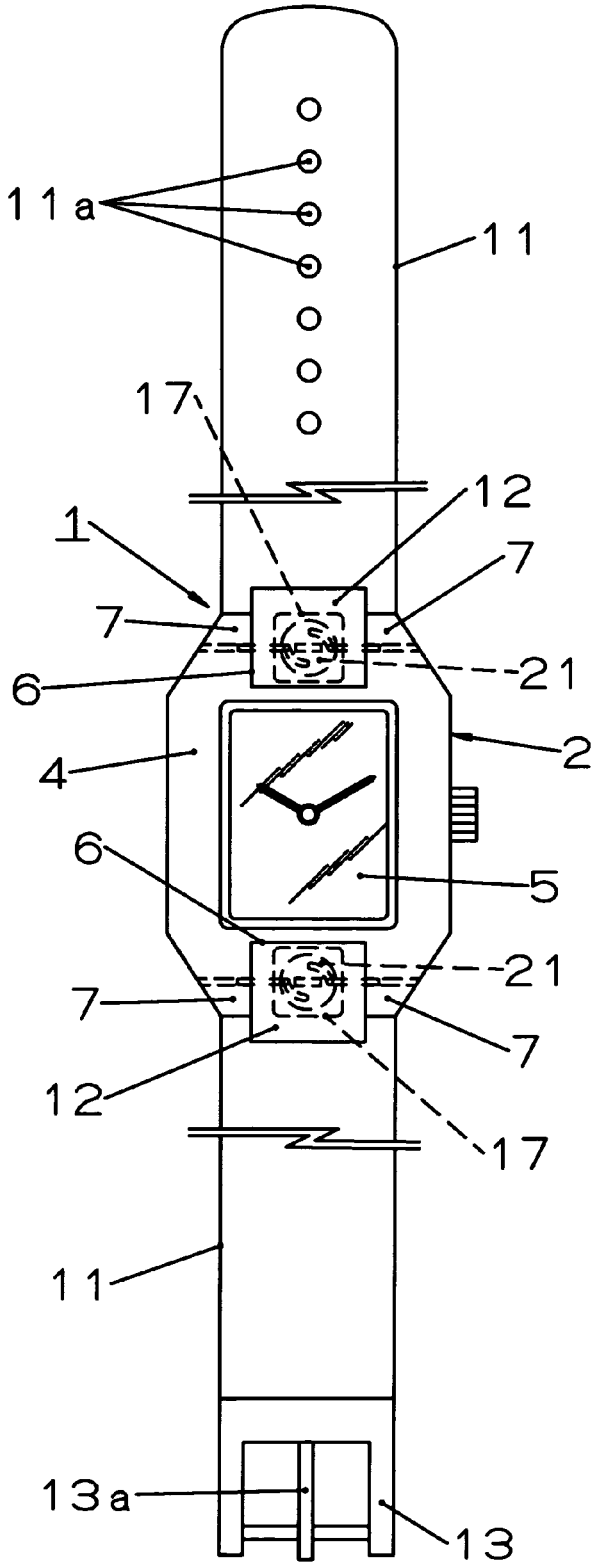
FIG. 10 is a front view showing a wristwatch concerned with a fourth embodiment of the present invention.

FIG. 10 shows a fourth embodiment of the present invention. Since the fourth embodiment is the same as the first embodiment except matters explained below, the same reference numeral as the first embodiment is applied about the same constitution as the first embodiment, and its explanation is omitted.

In the fourth embodiment, the band 11 is made of a leather, not made of the metal. In the engagement member 13 of one band 11, there is used a buckle and, in the other band 11, there are bored plural holes 11*a* into/from which an insertion bar 13*a* that the buckle has instead of the engagement member 14 (refer to FIG. 1) is inserted/retracted. Further, in one end parts of these bands 11, the end pieces 12 are respectively fixed, and the bands 11 are detachably attached to the case band 4 through these end pieces 12. Matters other than the above are the same as the first embodiment.

Therefore, since the wristwatch 1 of the fourth embodiment obtains the same actions as those explained in the first embodiment, for the user it is possible to easily attach/detach the end piece 12 of the band in regard to the bow feet 7 of the case band by using the coin or the like.

What is claimed is:

1. A wristwatch comprising:

a case band in which bow feet having attachment holes are protrusively provided and a bow crotch is formed between the adjoining bow feet; and a band being detachably attached to the case band, wherein there is made such that:

a concave part is formed in a back face of an end piece, of the band, received so as to be capable of being put in and out to and from the bow crotch, and through-holes facing on the attachment holes and communicating with the concave part under a state in which the end piece is received in the bow crotch are provided respectively in side walls, of the end piece, placed in both sides of the concave part, a rotation member having one pair of cam holes provided point-symmetrically and a rotation operation groove provided between these cam holes is rotatably held in the concave part with at least the rotation operation groove being exposed, and the cam hole is made a shape in which a distance in regard to a center of the rotation member becomes gradually small as going from one end to the other end of this cam hole, connection end parts comprising one end parts of one pair of connection members formed in L-shapes are passed through the through-holes, and cam follower end parts comprising the other end parts of the connection members are inserted into the cam holes, and the connection end parts are inserted into the attachment holes when the cam follower end parts are disposed in one ends of the cam holes by rotating the rotation member, and the connection end parts are pulled out from the attachment holes when the cam follower end parts are disposed in the other ends of the cam holes by rotating the rotation member.

2. A wristwatch according to claim 1, wherein the rotation operation groove forms a shape having a width and a length, which can receive a periphery part of a coin, and this rotation operation groove is provided between one ends of the one pair of cam holes so as to become parallel to the connection end parts.

3. A wristwatch according to claim 1, wherein a stabilization plate contacting with a back face of the rotation member is attached by being pressed-in to an outer periphery of the cam follower end part.

4. A wristwatch according to claim 2, wherein a stabilization plate contacting with a back face of the rotation member is attached by being pressed-in to an outer periphery of the cam follower end part.

5. A wristwatch according to claim 1, wherein there is made such that a moderation protrusion is provided in any one between the rotation member and a presser plate attached to the back face of the end piece while covering a periphery part of the rotation member so as to hold the rotation member in the concave part, and in the other there is provided a moderation groove with/from which the moderation protrusion is engaged/disengaged while following upon a rotation of the rotation member, and, under a state in which the connection end parts are inserted into the attachment holes, the rotation member is positioned by engaging the moderation protrusion and the moderation groove.

6. A wristwatch according to claim 2, wherein there is made such that a moderation protrusion is provided in any one between the rotation member and a presser plate attached to the back face of the end piece while covering a periphery part of the rotation member so as to hold the rotation member in the concave part, and in the other there is provided a moderation groove with/from which the moderation protrusion is engaged/disengaged while following upon a rotation of the rotation member, and, under a state in which the connection end parts are inserted into the attachment holes, the rotation member is positioned by engaging the moderation protrusion and the moderation groove.

7. A wristwatch according to claim 3, wherein there is made such that a moderation protrusion is provided in any one between the rotation member and a presser plate attached to the back face of the end piece while covering a periphery part of the rotation member so as to hold the rotation member in the concave part, and in the other there is provided a moderation groove with/from which the moderation protrusion is engaged/disengaged while following upon a rotation of the rotation member, and, under a state in which the connection end parts are inserted into the attachment holes, the rotation member is positioned by engaging the moderation protrusion and the moderation groove.

8. A wristwatch according to claim 4, wherein there is made such that a moderation protrusion is provided in any one between the rotation member and a presser plate attached to the back face of the end piece while covering a periphery part of the rotation member so as to hold the rotation member in the concave part, and in the other there is provided a moderation groove with/from which the moderation protrusion is engaged/disengaged while following upon a rotation of the rotation member, and, under a state in which the connection end parts are inserted into the attachment holes, the rotation member is positioned by engaging the moderation protrusion and the moderation groove.

9. A wristwatch according to claim 5, wherein there is possessed a bias means biasing the rotation member toward the presser plate.

10. A band for a wristwatch comprising:

bow feet having attachment holes and being provided in a case band of the wristwatch; and an end piece received so as to be capable of being put in and out to and from a bow crotch formed between the bow feet and detachably attached to the case band, wherein there is made such that:

a concave part is formed in a back face of the end piece of the band, and through-holes facing on the attachment holes and communicating with the concave part under a state in which the end piece is received in the bow crotch are provided respectively in side walls, of the end piece, placed in both sides of the concave part, a rotation member having one pair of cam holes provided point-symmetrically and a rotation operation groove provided between these cam holes is rotatably held in the concave part with at least the rotation operation groove being exposed and the cam hole is made a shape in which a distance in regard to a center of the rotation member becomes gradually small as going from one end to the other end of this cam hole, connection end parts comprising one end parts of one pair of connection members formed while being bent in L-shapes are passed through the through-holes, and cam follower end parts comprising the other end parts of the connection members are inserted into the cam holes, and the connection end parts are inserted into the attachment holes when the cam follower end parts are disposed in one ends of the cam holes by rotating the rotation member, and the connection end parts are pulled out from the attachment holes when the cam follower end parts are disposed in the other ends of the cam holes by rotating the rotation member.

11. A band for a wristwatch according to claim 10, wherein the rotation operation groove forms a shape having a width and a length, which can receive a periphery part of a coin, and this rotation operation groove is provided between one ends of the one pair of cam holes so as to become parallel to the connection end parts.

12. A band for a wristwatch according to claim 10, wherein a stabilization plate contacting with a back face of the rotation member is attached by being pressed-in to an outer periphery of the cam follower end part.

13. A band for a wristwatch according to claim 11, wherein a stabilization plate contacting with a back face of the rotation member is attached by being pressed-in to an outer periphery of the cam follower end part.

14. A band for a wristwatch according to claim 10, wherein there is made such that a moderation protrusion is provided in any one between the rotation member and a presser plate attached to the back face of the end piece while covering a periphery part of the rotation member so as to hold the rotation member in the concave part, and in the other there is provided a moderation groove with/from which the moderation protrusion is engaged/disengaged while following upon a rotation of the rotation member, and, under a state in which the connection end parts are inserted into the attachment holes, the rotation member is positioned by an engagement between the moderation protrusion and the moderation groove.

15. A band for a wristwatch according to claim 11, wherein there is made such that a moderation protrusion is provided in any one between the rotation member and a presser plate attached to the back face of the end piece while covering a periphery part of the rotation member so as to hold the rotation member in the concave part, and in the other there is provided a moderation groove with/from which the moderation protrusion is engaged/disengaged while following upon a rotation of the rotation member, and, under a state in which the connection end parts are inserted into the attachment holes, the rotation member is positioned by an engagement between the moderation protrusion and the moderation groove.

16. A band for a wristwatch according to claim 12, wherein there is made such that a moderation protrusion is provided in any one between the rotation member and a presser plate attached to the back face of the end piece while covering a periphery part of the rotation member so as to hold the rotation member in the concave part, and in the other there is provided a moderation groove with/from which the moderation protrusion is engaged/disengaged while following upon a rotation of the rotation member, and, under a state in which the connection end parts are inserted into the attachment holes, the rotation member is positioned by an engagement between the moderation protrusion and the moderation groove.

17. A band for a wristwatch according to claim 13, wherein there is made such that a moderation protrusion is provided in any one between the rotation member and a presser plate attached to the back face of the end piece while covering a periphery part of the rotation member so as to hold the rotation member in the concave part, and in the other there is provided a moderation groove with/from which the moderation protrusion is engaged/disengaged while following upon a rotation of the rotation member, and, under a state in which the connection end parts are inserted into the attachment holes, the rotation member is positioned by an engagement between the moderation protrusion and the moderation groove.

18. A band for a wristwatch according to claim 14, wherein there is possessed a bias means biasing the rotation member toward the presser plate.

* * * * *